US011627793B2

(12) United States Patent
Berhault et al.

(10) Patent No.: US 11,627,793 B2
(45) Date of Patent: Apr. 18, 2023

(54) APPLICATOR MEMBER FOR APPLYING A PRODUCT, IN PARTICULAR A COSMETIC PRODUCT, AND ASSEMBLY FOR PACKAGING AND APPLYING A PRODUCT, COMPRISING SAID APPLICATOR MEMBER

(71) Applicant: L'Oreal, Paris (FR)

(72) Inventors: Alain Berhault, Clichy (FR); Eric Caulier, Clichy (FR); Audrey Thenin, Clichy (FR)

(73) Assignee: L'OREAL, Paris (FR)

( * ) Notice: Subject to any disclaimer, the term of this patent is extended or adjusted under 35 U.S.C. 154(b) by 368 days.

(21) Appl. No.: 16/956,378

(22) PCT Filed: Dec. 10, 2018

(86) PCT No.: PCT/EP2018/084219
§ 371 (c)(1),
(2) Date: Jun. 19, 2020

(87) PCT Pub. No.: WO2019/121118
PCT Pub. Date: Jun. 27, 2019

(65) Prior Publication Data

US 2020/0359768 A1 Nov. 19, 2020

(30) Foreign Application Priority Data

Dec. 19, 2017 (FR) ..... 1762452

(51) Int. Cl.
*A45D 40/26* (2006.01)
*A46B 9/02* (2006.01)

(52) U.S. Cl.
CPC ..... *A45D 40/267* (2013.01); *A46B 9/021* (2013.01); *A45D 2200/25* (2013.01); *A46B 2200/1053* (2013.01)

(58) Field of Classification Search
CPC .... A45D 40/26; A45D 40/262; A45D 40/265; A45D 40/267; A45D 2200/10;
(Continued)

(56) References Cited

U.S. PATENT DOCUMENTS

2016/0157586 A1 6/2016 Pires et al.
2019/0014895 A1* 1/2019 De Bardonneche ..... A45D 40/264

FOREIGN PATENT DOCUMENTS

WO 2012/085398 A2 6/2012
WO 2012/085398 A4 6/2012
(Continued)

OTHER PUBLICATIONS

International Search Report and Written Opinion dated Feb. 22, 2019, issued in corresponding International Application No. PCT/EP2018/084219, filed Dec. 10, 2018, 14 pages.

*Primary Examiner* — Rachel R Steitz
(74) *Attorney, Agent, or Firm* — Christensen O'Connor Johnson Kindness PLLC

(57) ABSTRACT

Applicator member (40) for applying a product, in particular a cosmetic product, comprising: a core (42) extending along a longitudinal axis (X2-X2'), an applicator part comprising at least a plurality of application elements (44) that are joined to the core and extend over a first sector of said core (42), and a shaping part comprising an arm (46) that is joined to the core (42) by its two ends and extends over a second sector of said core, separate from said first sector bearing the application elements (44), the arm (46) having no application elements and being at least partially made of rigid material.

9 Claims, 3 Drawing Sheets

(58) Field of Classification Search
CPC ..... A46B 9/021; A46B 2200/10; A46B 2200/1053; A46B 2200/106
See application file for complete search history.

(56) References Cited

FOREIGN PATENT DOCUMENTS

| | | | |
|---|---|---|---|
| WO | 2016/042216 | A1 | 3/2016 |
| WO | 2017/115022 | A1 | 7/2017 |

* cited by examiner

APPLICATOR MEMBER FOR APPLYING A PRODUCT, IN PARTICULAR A COSMETIC PRODUCT, AND ASSEMBLY FOR PACKAGING AND APPLYING A PRODUCT, COMPRISING SAID APPLICATOR MEMBER

The present invention relates to an applicator member for a cosmetic product applicator.

The term "cosmetic product" is understood, notably within the meaning of the present invention, to mean a product as defined in Regulation (EC) No 1223/2009 of the European Parliament and of the Council of 30 Nov. 2009 relating to cosmetic products.

More particularly, the applicator member according to the present invention is intended for the application of a cosmetic product, such as a makeup or care product, for example to keratin fibres, and notably for the application of mascara to the eyelashes or eyebrows.

Mascara is understood to be a composition intended to be applied to the eyelashes or eyebrows. It may notably be a makeup composition for the eyelashes or eyebrows, a makeup base for the eyelashes, known as "base coat", a composition to be applied over mascara, known as "top coat", or a composition for the cosmetic treatment of the eyelashes or eyebrows.

Numerous cosmetic product applicators that are intended to apply said product notably to keratin fibres, in particular to apply mascara to eyelashes, are known.

Generally, an applicator comprises an applicator member that defines an application surface intended to come into contact with the part of the body to be treated.

The applicator member has a main body or core, of generally elongate shape, which is able to bear application elements that project from said core. Preferably, the application elements extend in a general direction substantially normal to the core.

The applicator also comprises a stem which is secured to a gripping member and at the end of which the applicator member is fastened. The gripping member is generally able to close off, in a sealed manner, the opening of the container containing the cosmetic product.

The container is generally provided with a wiping member for wiping the stem and the applicator member during the withdrawal thereof from the container, in order to remove excess product before application.

In addition to the particular composition of the cosmetic product, the applicator plays an important role in the quality of application of the cosmetic product and in the quantity of product deposited. The quantity of product to be deposited is furthermore generally adapted by a wiping member known as a "wiper".

The document WO 2016/177827-A1 (L'Oréal) proposes a mascara applicator comprising a core that extends along a longitudinal axis and bears one or two flexible arms provided with protruding application elements.

The document WO 2012/085398-A2 (Montaigu) also relates to an applicator device comprising an elongate core and a pliant and flexible stem that is oriented longitudinally and embedded at two points on the core and bears spikes that are oriented radially with respect to the stem.

However, such applicators do not make it possible to shape the eyelashes.

There is a need to improve applicators for applying a product, notably mascara, to the eyelashes and/or eyebrows, in order to improve the performance thereof, and, if need be, allow the eyelashes to be shaped.

The invention aims to meet this objective and the subject thereof is an applicator member for applying a product, in particular a cosmetic product, comprising a core extending along a longitudinal axis, an applicator part comprising at least a plurality of application elements or spikes that are joined to the core and extend over a first sector of said core, and a shaping part comprising a single arm that is joined to the core by its two ends and extends over a second sector of said core, separate from said first sector bearing said application elements.

The arm has no application elements and is partially made of rigid material, such that the arm is capable of exerting a pressure on the eyelashes in order to curl them, in particular following application of the product by the applicator part formed by the application elements.

Thus, the applicator member may both load the eyelashes with product while separating them via the application elements, and shape the eyelashes loaded with product by virtue of the rigidity of the arm disposed over a portion of the core separate from the portion containing the application elements. The applicator member thus fulfils a dual function.

The "longitudinal axis of the core" means the line connecting all of the centres of mass of the cross sections of the core.

The longitudinal axis of the core may be central, or even an axis of symmetry for the core, in particular when the core has a circular cross section or a cross section in the overall shape of a regular polygon. The longitudinal axis of the core may be rectilinear or curved.

The expression "application element or spike" denotes an individualizable projecting element intended to come into engagement with the eyelashes and/or eyebrows.

The term "rigid" means any member which, on account of the material used and/or the dimensions thereof, substantially does not deform under the action of a load exerted by the user during application to an application surface, for example the eyelashes, or during passage through a wiping member.

Advantageously, the arm comprises an arched portion, a proximal end portion joined to a proximal end of the arched portion and to a proximal end of the core, and a distal end portion joined to a distal end of the arched portion and to a distal end of the core.

For example, the arched portion is made of rigid material and the end portions are made of material that is more flexible than the material of the arched portion. Thus, the end portions are deformable upon wiping and the arched portion, which is more rigid than the end portions, makes it possible to exert a pressure on the eyelid.

For example, the arched portion exhibits concavity towards the outside of the applicator member.

The arched portion preferably has a shape curved along a first arc of a circle with a radius of curvature for example equal to 34.015 mm. In a variant, a radius of curvature of between 20 mm and 40 mm could be provided. For example, the length of the core is equal to 28.95 mm. In a variant, a length of the core of between 15 mm and 35 mm could be provided.

Advantageously, the arched portion is radially offset from the outer surface of the core and, with said core, leaves a free space for retaining product.

Said free space is able to fill up with product while the applicator member is being withdrawn from the container. For example, the arched portion forms, with each of the end portions, an elbow for example equal to 120°.

The width of the arched portion may be variable along the longitudinal axis thereof.

For example, the width of the arched portion is less at its ends joined to the proximal and distal end portions. The width at the ends of the arched portion is, for example, equal to 1.15 mm, while the width at the centre of said arched portion is equal to 2.93 mm. In a variant, a constant width of the arched portion could be provided.

According to one embodiment, the application elements and the arm are produced in one piece with the core by moulding thermoplastic material.

Any thermoplastic material that is relatively rigid, for example SEBS (styrene-ethylene/butylene-styrene), a thermoplastic elastomer or the like, can be used to mould the applicator member.

The arm may be for example flocked.

Provision could also be made for the arm to be overmoulded or assembled with the core, such that a different material from the core is used, in particular in order to obtain an arm that is more rigid than the core.

The first angular sector of the core bearing the application elements is between 45° and 180°, preferably equal to 180°.

The application elements each extend from a sector of the core along an elongation axis perpendicular to the surface of the core, at the point at which the application element is attached to the core.

The application elements are, for example, disposed in groups of application elements within a number of rectilinear longitudinal rows of between two and nine. Preferably, the groups of application elements are regularly spaced along the longitudinal rows and each have two application elements, apart from the application element group close to the distal end of the core, which only has one application element.

In a variant, groups of application elements having a different number of application elements could be provided, or provision could also be made for the number of application elements to differ from one group to another within one and the same longitudinal row.

The spacing between the application elements of a group is in this case the same for each group. Provision could be made for the spacing between the application elements of a group to differ from one group of application elements to another.

Advantageously, the height of the application elements varies regularly, along the longitudinal axis of the core. Within one and the same longitudinal row, the height of the application elements may decrease in the direction of the distal end of the core. In a variant, provision could be made for the height of the application elements to be constant along the longitudinal axis of the core.

For example, all the application elements are the same conical shape. Any other shape could be provided for the application elements, for example semi-conical. The cross section of the application elements is advantageously circular in shape. In a variant, the cross section of the application elements may be semicircular, elliptical, polygonal or any other shape.

In a variant, the shape of the application elements differs within the groups of application elements.

Advantageously, the distance between the centre of the core and the end of the arm, in particular of the arched portion thereof, is greater than the distance between the centre of the core and the end of the application elements.

For example, the distance between the centre of the core and the end of the arm, in particular of the arched portion thereof, is equal to 5.74 mm and the distance between the centre of the core and the end of the application elements is equal to 3.885 mm.

According to a second aspect, the invention relates to an applicator for applying a product, in particular a cosmetic product, comprising an applicator member as described above and a gripping member that is connected to the applicator member directly or indirectly via a stem.

For example, the applicator member comprises an end piece from which the core extends and the gripping member is connected to the end piece of the applicator member directly or indirectly, via the stem.

According to a third aspect, the invention relates to an assembly for packaging and applying a product, in particular a cosmetic product, comprising a container delimiting at least one internal volume containing said product; and an applicator as described above, at least the applicator member of which is disposed inside the container in order to be loaded with product contained in said container.

The assembly comprises, for example, a wiping member that is designed to wipe at least the applicator member, in particular the applicator part and the shaping part, and is fastened to the container. The shaping part is sufficiently rigid to not deform upon passing through the wiping member.

According to a fourth aspect, the invention relates to a cosmetic makeup process, in particular for applying a cosmetic product in particular to the eyelashes, comprising the following steps of applying the product to the eyelashes with the aid of the application part of an applicator member of an applicator as described above, and applying the arm of said applicator member to the eyelashes, exerting a force on the eyelashes in order to curl them. The shape and the rigidity of the arm thus makes it possible to satisfactorily curl the eyelashes.

Further aims, features and advantages of the invention will become apparent from reading the following description, which is given only by way of non-limiting example and with reference to the appended drawings, in which.

Figure 1:
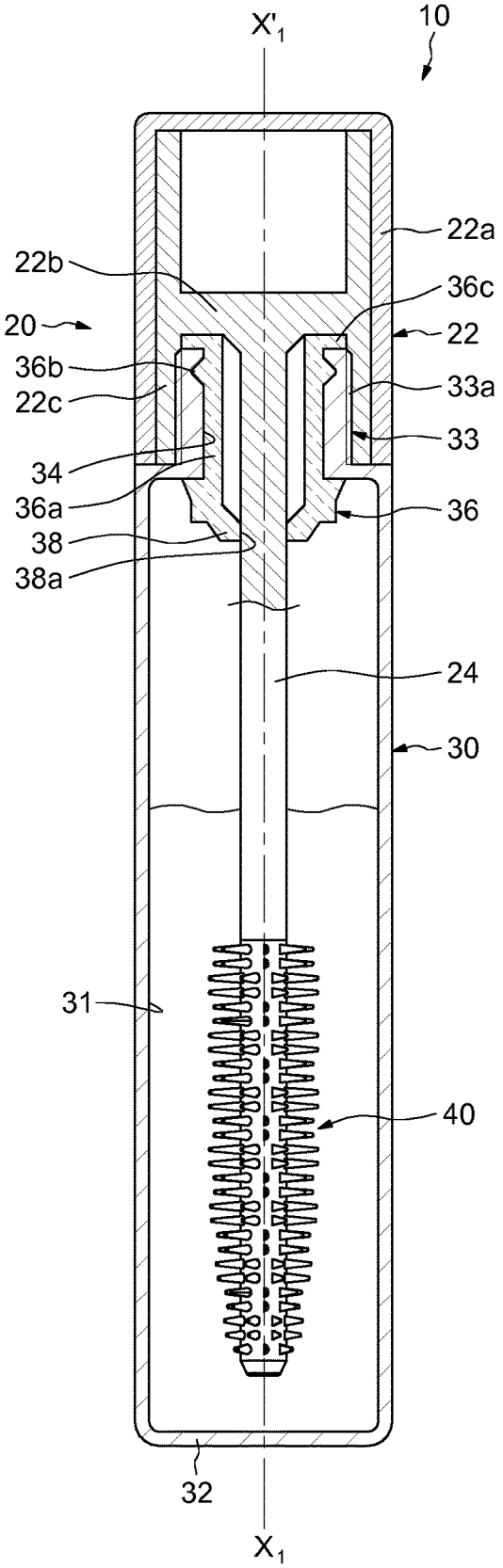
FIG. 1 is a view of an assembly for packaging and applying a product according to one embodiment of the invention.

As illustrated in FIG. 1, an assembly 10 for packaging and applying a product comprises an application device or applicator 20 and an associated container 30 delimiting an internal volume 31 containing said product to be applied to a user's eyelashes, for example mascara or a care product.

The container 30 extends along a longitudinal overall axis X1-X1', shown in a position presumed to be vertical.

The body of the container 30 is provided with a closed lower end 32 forming a bottom and an upper end 33 forming a neck provided with an opening 34, opposite the lower end 32, allowing access to the internal volume 31 containing the product. In a variant, provision could be made for the body of the container not to comprise a neck and for the opening to be made in a free edge of said container.

In the embodiment illustrated, the neck 33 has an outside diameter smaller than the outside diameter of the body of the container 30 and comprises, on its outer surface, a thread **33*a* that is intended to engage with a corresponding internal thread of a gripping member 22 of the applicator 20. The body of the container 30** may be made, for example, of rigid plastics material.

Without implying any limitation, the gripping member 22 of the applicator 20 forms a container 30 closure cap designed to be fastened on the neck 33 of the container so as to close said container in a sealed manner when it is not in use. To this end, the gripping member 22 has a tubular mounting skirt 22*a* and a transverse wall 22*b* that extends substantially perpendicularly to the axis X1-X1' and is attached to the mounting skirt 22*a*. The mounting skirt 22*a* comprises a threaded inner surface 22*c* that is intended to be screwed onto the thread 33*a* on the neck of the container 30. In a variant, provision could be made for the gripping member 22 to close off the opening 34 of the container 30 in any other way.

The applicator 20 also has a stem 24 which is joined at its upper end to the gripping member 22 and, at its lower end, at the opposite end from the gripping member, to an applicator member 40 which will be described in detail with reference to FIGS. 2 to 4.

The container 30 also comprises a wiping member 36 suitable for wiping the stem 24 and the applicator member 40. This wiping member 36, which may be of any suitable type, has, in the example illustrated, a tubular body 36*a* of substantially cylindrical shape with an outside diameter substantially equal to the inside diameter of the neck 33 of the container 30. The body 36*a* comprises, on its outer surface, a member 36*b* for retaining on the container 30, in the form of an annular bulge that is intended to be snap-fastened in a corresponding groove (not referenced) formed on the inner surface of the neck. As alternatives, provision could be made for the retaining member to be in the form of a plurality of mutually parallel annular bulges or for the bulge to comprise at least two semicircular portions that are spaced apart from one another around the circumference of the body of the wiping member.

The wiping member 36 also has, at a first free end of the body, an annular flange 36*c* having an outside diameter substantially equal to the inside diameter of the mounting skirt 22*a* of the gripping member 22 and axially bearing against the neck 33 of the container 30.

The wiping member 36 comprises, at a second end at the opposite end from the first end, an annular wiping lip 38 that defines with its free end a wiping orifice 38*a* with a substantially circular cross section. This wiping lip 38 extends obliquely in the direction of the stem 24 and is dimensioned so as to press against the applicator member 40 during withdrawal from the container 30. The wiping lip 38 in this case extends obliquely with respect to the body 36*a* towards the axis X1-X1'.

The inside diameter of the orifice 38*a* is preferably less than or equal to the outside diameter of the stem 24, so as to prevent the product contained in the container 30 from escaping towards the outside.

The wiping member 36 may be made for example of an elastomer material or a polyolefin, in particular polyethylene or any other plastics material. The wiping lip 38 is, for example, more flexible than the body 36*a* of the wiping member 36.

Figure 2:
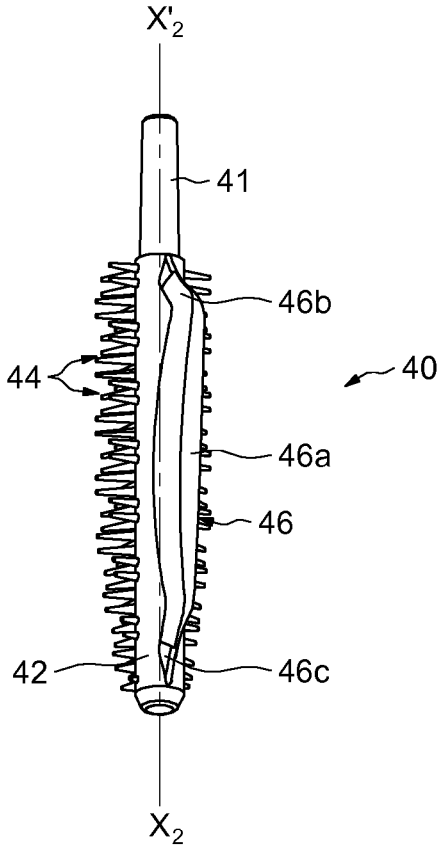
FIG. 2 shows a perspective view of the applicator member for applying a cosmetic product in FIG. 1.
Figure 3:
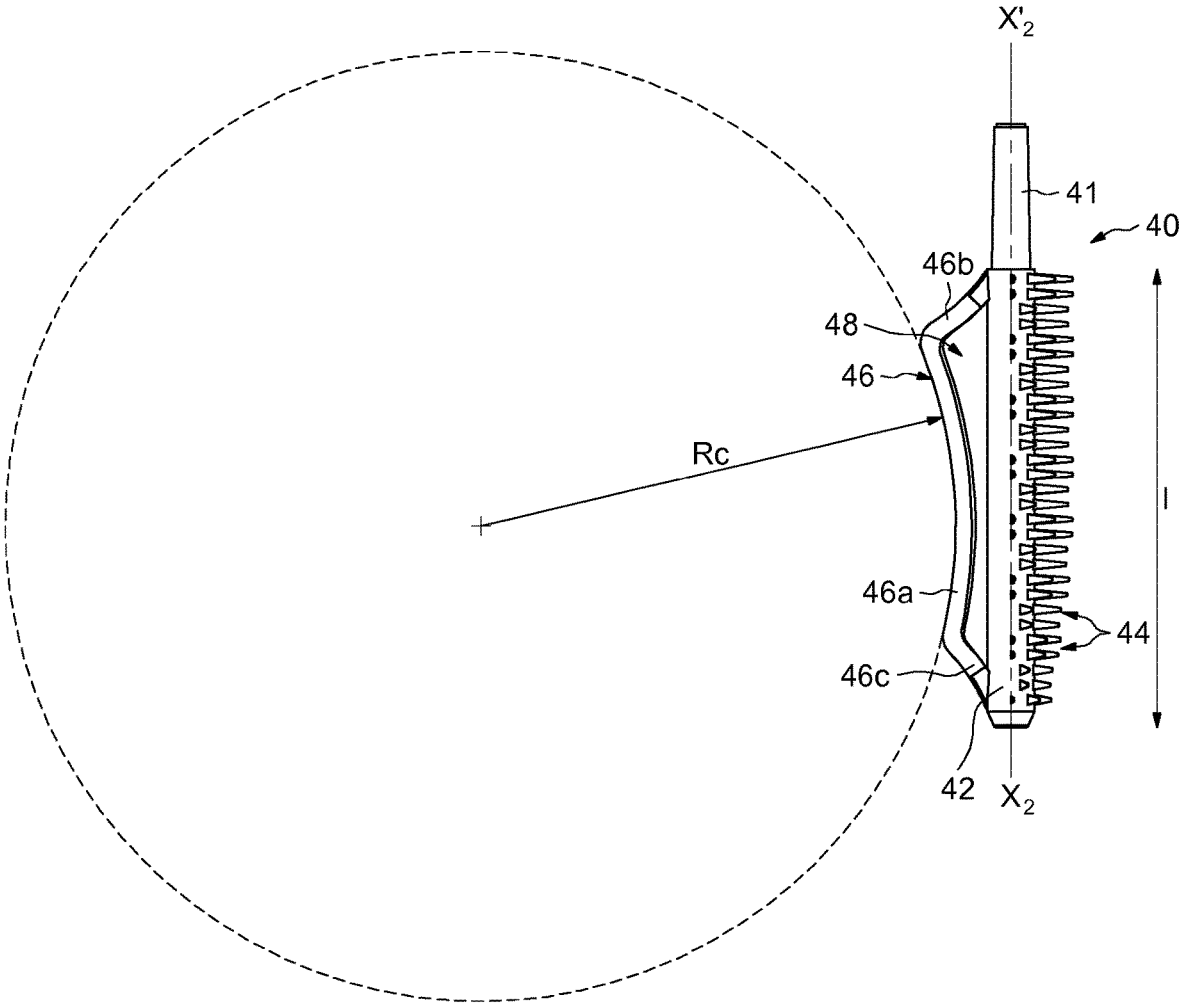
FIG. 3 is a side view of the applicator member in FIG. 2.
Figure 4:
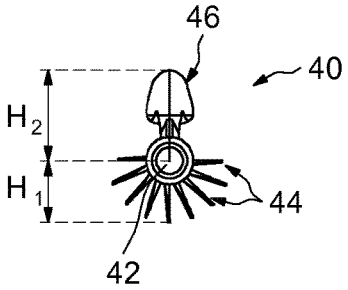
FIG. 4 is a bottom view of the applicator member in FIG. 2.

As illustrated in detail in FIGS. 2 to 4, the applicator member 40 comprises an end piece 41 for fastening in a corresponding housing (not shown) in the stem 24. The applicator member 40 may be fixed to the stem 24 by any means, and notably by force-fitting, snap-fastening, adhesive bonding, welding or crimping in this housing.

The applicator member 40 also comprises a core 42 of elongate shape that extends along a longitudinal axis X2-X2' which is coincident with the longitudinal axis X1-X1' in FIG. 2. The core 42 axially extends the end piece 41.

The core 42 may have a constant or non-constant cross section along the longitudinal axis. In the example illustrated, the distal free end of the core 42 has a smaller cross section compared with the cross section of the proximal end thereof.

The cross section of the core 42 is in this case circular, but could have any other shape, semicircular, polygonal, oval or the like. The core may also be materially solid or hollow. In the example illustrated, the core 42 is cylindrical and hollow.

As illustrated, the core 42 bears a plurality of application elements 44 or spikes. A "spike" denotes an individualizable projecting element intended to come into engagement with the eyelashes and/or eyebrows.

The spikes 44 each extend from a first sector of the core 42 along an elongation axis perpendicular to the surface of the core 42, at the point at which the spike 44 is attached to the core 42. The angular portion of the core bearing the spikes 44 is equal to 180° and forms an applicator part for applying the product to the eyelashes.

In the example illustrated, the spikes 44 are disposed in groups of spikes within nine rectilinear longitudinal rows. Preferably, as illustrated, the groups of spikes are regularly spaced along the longitudinal rows and each have two spikes, apart from the group of spikes close to the distal end of the core, which only has one spike.

In a variant, groups of spikes having a different number of spikes could be provided, or provision could also be made for the number of spikes to differ from one group of spikes to another within one and the same longitudinal row. In a variant, a plurality of spikes that extend from the first sector of the core 42 and are not arranged in the form of rows could also be provided.

The spacing between the spikes of a group is in this case the same for each group. Provision could be made for the spacing between the spikes of a group to differ from one group of spikes to another.

In the example illustrated, the height of the spikes varies regularly along the longitudinal axis of the core 42. Within one and the same longitudinal row, the height of the spikes decreases in the direction of the distal end of the core 42. In a variant, provision could be made for the height of the spikes to be constant along the longitudinal axis of the core.

As illustrated, all the spikes are the same conical shape.

In the example illustrated, an arm 46 is joined by its two ends to a second sector of the core 42, separate from the first sector of the core 42 bearing the spikes 44. In the example illustrated, the two sectors are on opposite sides with respect to the longitudinal axis of the core 42. In a variant, provision could be made for the two sectors not to be symmetric with respect to the longitudinal axis of the core, while being separate from one another.

The arm 46 comprises an arched portion 46*a* and a proximal end portion 46*b* and a distal end portion 46*c*, one of which is joined to a proximal end of the arched portion 46*a* and to a proximal end of the core 42 and the distal end is joined to a distal end of the arched portion 46*a* and to a distal end of the core 42.

The arched portion 46*a* forms, with each of the end portions 46*b*, 46*c*, an elbow substantially equal to 120°. Thus, the arched portion 46*a* is radially offset from the cylindrical outer surface of the core 42.

A free space 48 for retaining product is disposed between the arm 46 and the core 42 and is capable of filling up with product as the applicator member is withdrawn from the container.

The arched portion 46*a* exhibits concavity towards the outside of the applicator member 40.

The arm 46 is made, for example, of rigid plastics material in order to be able to exert a pressure on the eyelashes in order to curl them. The arm 46 may thus be considered to be a part for shaping the eyelashes, in particular following the application of the product by the applicator part formed by the spikes 44.

The arm 46, and in particular the arched portion 46*a*, has no spikes and is substantially smooth.

In the example illustrated, the width of the arched portion 46*a* is variable along the longitudinal axis thereof. The width of the arched portion 46*a* is in this case smaller at the ends joined to the end portions 46*b*, 46*c*. The width at the ends of the arched portion 46*a* is, for example, equal to 1.15 mm, while the width at the centre of said arched portion is, for example, equal to 2.93 mm. In a variant, a constant width of the arched portion 46*a* could be provided.

The arched portion 46*a* has a shape curved along a first arc of a circle with a radius of curvature Rc equal to 34.015 mm in the example illustrated. In a variant, a radius of curvature of between 20 mm and 40 mm could be provided. In the example illustrated, the length 1 of the core is equal to 28.95 mm. In a variant, a length of the core of between 15 mm and 35 mm could be provided.

As can be seen in FIG. 4, the distance H2 between the centre of the core 42 and the end of the arm 46, in particular of the arched portion 46*a* thereof, is greater than the distance H1 between the centre of the core 42 and the end of the application elements 44.

In the example illustrated, the distance H2 between the centre of the core and the end of the arm, in particular of the arched portion thereof, is equal to 5.74 mm and the distance H1 between the centre of the core and the end of the application elements is equal to 3.885 mm.

The spikes 44 and the arm 46 are made, in the example in question, in one piece with the core by moulding thermoplastic material.

Any thermoplastic material that is relatively rigid, for example SEBS (styrene-ethylene/butylene-styrene), a thermoplastic elastomer or the like, can be used to mould the applicator member 40.

The arm may be for example flocked.

Provision could also be made for the arm 46 to be overmoulded or assembled with the core 42, such that a different material from the core is used, in particular in order to obtain an arm 46 that is more rigid than the core 42.

In order to use the applicator 10, the user unscrews the closure cap 22 and withdraws the applicator member 40 from the container 30.

Once the applicator member 40 has passed through the wiping member 36, a quantity of product remains in the spike-free spaces created between the groups of spikes, creating reservoirs of product along the entire length of a sector of the core 42, and in the free space for retaining product between the core and the arm.

The eyelashes and/or eyebrows are separated by the spikes forming an application part for applying the product. The user then turns the applicator member round and applies the arm to the eyelashes, exerting a force on the eyelashes in order to curl them. The shape and the rigidity of the arm thus makes it possible to satisfactorily curl the eyelashes.

In this way, a cosmetic product applicator having a dual function is obtained that makes it possible to load the eyelashes with product while separating them and also to shape the eyelashes loaded with product by virtue of the rigidity of the curved arm.

The invention claimed is:

1. Applicator member (40) for applying a product, in particular a cosmetic product, comprising:

a core (42) extending along a longitudinal axis (X2-X2'), an applicator part comprising at least a plurality of application elements (44) that are joined to the core and extend over a first sector of said core (42), and a shaping part comprising an arm (46) that has no application elements and is joined to the core (42) by its two ends and extends over a second sector of said core, separate from said first sector bearing the application elements (44), wherein the arm (46) comprises an arched portion (46*a*), a proximal end portion (46*b*) joined to a proximal end of the arched portion (46*a*) and to a proximal end of the core (42), and a distal end portion (46*c*) joined to a distal end of the arched portion (46*a*) and to a distal end of the core (42), said arched portion (46*a*) being made of rigid material and the end portions (46*b*, 46*c*) are made of material that is more flexible than the material of the arched portion (46*a*) and wherein the arched portion (46*a*) is radially offset from the outer surface of the core (42) and, with said core (42), leaves a free space (48) for retaining product.

2. Applicator member according to claim 1, wherein the arched portion (46*a*) exhibits concavity towards the outside of the applicator member (40).

3. Applicator member according to claim 1, wherein width of the arched portion (46*a*) is variable along the longitudinal axis thereof.

4. Applicator member according to claim 1, wherein the application elements (44) and the arm (46) are produced in one piece with the core (42) by moulding thermoplastic material.

5. Applicator member according to claim 1, wherein the first angular sector of the core (42) bearing the application elements (44) is between 45° and 180°.

6. Applicator member according to claim 1, wherein the distance (H2) between a centre of the core (42) and an end of the arm (46) is greater than the distance (H1) between the centre of the core (42) and the end of the application elements (44).

7. Applicator for applying a product, in particular a cosmetic product, comprising an applicator member according to claim 1 and a gripping member (22) that is connected to the applicator member (40) via a stem (24).

8. Assembly for packaging and applying a product, in particular a cosmetic product, comprising:

a container (30) delimiting at least one internal volume (31) containing said product; and an applicator according to claim 7, at least the applicator member (40) of which is disposed inside the container (30) in order to be loaded with product contained in said container.

9. Cosmetic makeup process, in particular for applying a cosmetic product in particular to the eyelashes, comprising the following steps of:

applying the product to the eyelashes with the aid of the application part (44) of an applicator member (40) of an applicator (20) according to claim 7, and applying the arm (46) of the applicator member (40) to the eyelashes, exerting a force on the eyelashes in order to curl them.

* * * * *